United States Patent [19]

Obermair

[11] 4,210,337

[45] Jul. 1, 1980

[54] ALIGNMENT GAME

[75] Inventor: Gilbert K. J. Obermair, Munich, Fed. Rep. of Germany

[73] Assignee: J. W. Spear & Sons Limited, United Kingdom

[21] Appl. No.: 868,679

[22] Filed: Jan. 11, 1978

[30] Foreign Application Priority Data

Jan. 14, 1977 [GB] United Kingdom ..... 1567/77

[51] Int. Cl.[2] ..... A63F 3/00

[52] U.S. Cl. ..... 273/264; 273/287

[58] Field of Search ..... 273/281, 264, 271, 258

[56] References Cited

U.S. PATENT DOCUMENTS

| | | | |
|---|---|---|---|
| 1,700,016 | 1/1929 | Belanger | 273/281 |
| 2,528,792 | 11/1950 | Seaman | 273/258 |
| 3,727,916 | 4/1973 | Miller | 273/281 |

FOREIGN PATENT DOCUMENTS

| | | | |
|---|---|---|---|
| 797013 | 6/1958 | United Kingdom | 273/271 |

*Primary Examiner*—Richard C. Pinkham
*Assistant Examiner*—R. Carl Moy
*Attorney, Agent, or Firm*—Kane, Dalsimer, Kane, Sullivan and Kurucz

[57] ABSTRACT

A board game for two or more players in which the board has a playing area comprising two sets of parallel rows, the intersection of the rows defining regions for receiving playing pieces (preferably balls). The playing pieces in a row in which all its receiving regions are occupied are movable together along the axis of that row by applying a force to one of the two end pieces in that row so that each of the pieces in that row except the other end piece is moved into its next adjacent receiving region in that row.

12 Claims, 3 Drawing Figures

ALIGNMENT GAME

This invention relates to a board game.

The present invention provides a game comprising at least two sets of playing pieces, each playing piece being in the form of a ball and having an identifiable characteristic, the playing pieces in each set having the same identifiable characteristic, which characteristic is different from the identifiable characteristic of the elements in the other set or sets, and a board defining a playing area, the playing area comprising two sets of parallel rows of channels, the rows in one set of rows lying transverse to the rows in the other set of rows, each of the intersections between the rows in one set and the rows in the other set defining a pocket for receiving a playing piece, and the board further defining a playing piece receiving region outside the playing area; wherein the number of playing pieces is such that every receiving region in the playing area can simultaneously be occupied by a playing piece and such that the number of pieces in one set of pieces on the playing area is the same as or one more than the number of pieces in the other set or sets of pieces on the playing area, and wherein the playing pieces in a row in which all its pockets are occupied are movable together along the axis of that row by applying a force to one of the two end pieces in that row, using a playing piece which is in the said receiving region, so that each of the pieces in that row except the other end piece is moved into its next adjacent pocket in that row, so that the said other end piece is moved off the playing area and into the said receiving region and so that the playing piece used to apply the force is received in the pocket previously occupied by the said one end piece.

Preferably the spacing between adjacent rows in one set is the same and equal to the spacing between adjacent rows in the other set.

Advantageously, at least one end of each row is extended beyond the playing area, the extension of each row defining an individual playing piece receiving region, those individual regions being arranged in two further rows, one lying substantially parallel to one of the sets of rows and the other lying substantially parallel to the other set of rows.

A further playing piece can be arranged in one of the individual receiving regions and used to apply the said force to the end piece in the row to which the said one region forms an extension; each of the pieces in that row except the other end piece being moved into its next adjacent pocket in that row, the said other end piece being moved off the playing area. Alternatively, each individual receiving region can be used to receive a playing piece displaced from the playing area proper, that is to say from the row to which it forms an extension.

Each end of each row may be extended beyond the playing area, each extension of each row defining an individual playing piece receiving region, those individual regions being arranged in four further rows, one of the sets of rows lying between and substantially parallel to two further rows, and the other set of rows lying between and substantially parallel to the other further rows. In this case, a piece moved off the playing area will always be moved into a respective one of the individual receiving regions.

Advantageously, each of the individual regions which is in a (or the) further row lying parallel to one of the sets of rows and each of the individual regions which is in a (or the) row lying parallel to the other set of rows has an identifiable characteristic, for example a number or letter. In this case the playing piece which is placed in one of the individual regions to displace the playing pieces in a row, can be placed in any one of the identified individual regions.

The two sets of rows may be arranged at various angles to each other, but it is of advantage if the two sets of rows lie at right-angles to each other.

Further, although the playing area may take various shapes, it is of advantage, for reasons of simplicity, if the playing area is of square shape.

Although the identifiable characteristic of each playing piece may be a pattern or number, it is of advantage if the colour of each playing piece defines the identifiable characteristic of that playing piece.

It is possible to use more than two sets of playing pieces but in order to keep the game relatively simple it is of advantage if there are only two sets of playing pieces.

A board game constructed in accordance with the invention will now be described, by way of example only, with reference to the accompanying drawings, in which.

Referring to the accompanying drawings, the game consists of a playing board indicated generally at 101 and twenty-six playing pieces in the form of spherical balls.

Figure 1:
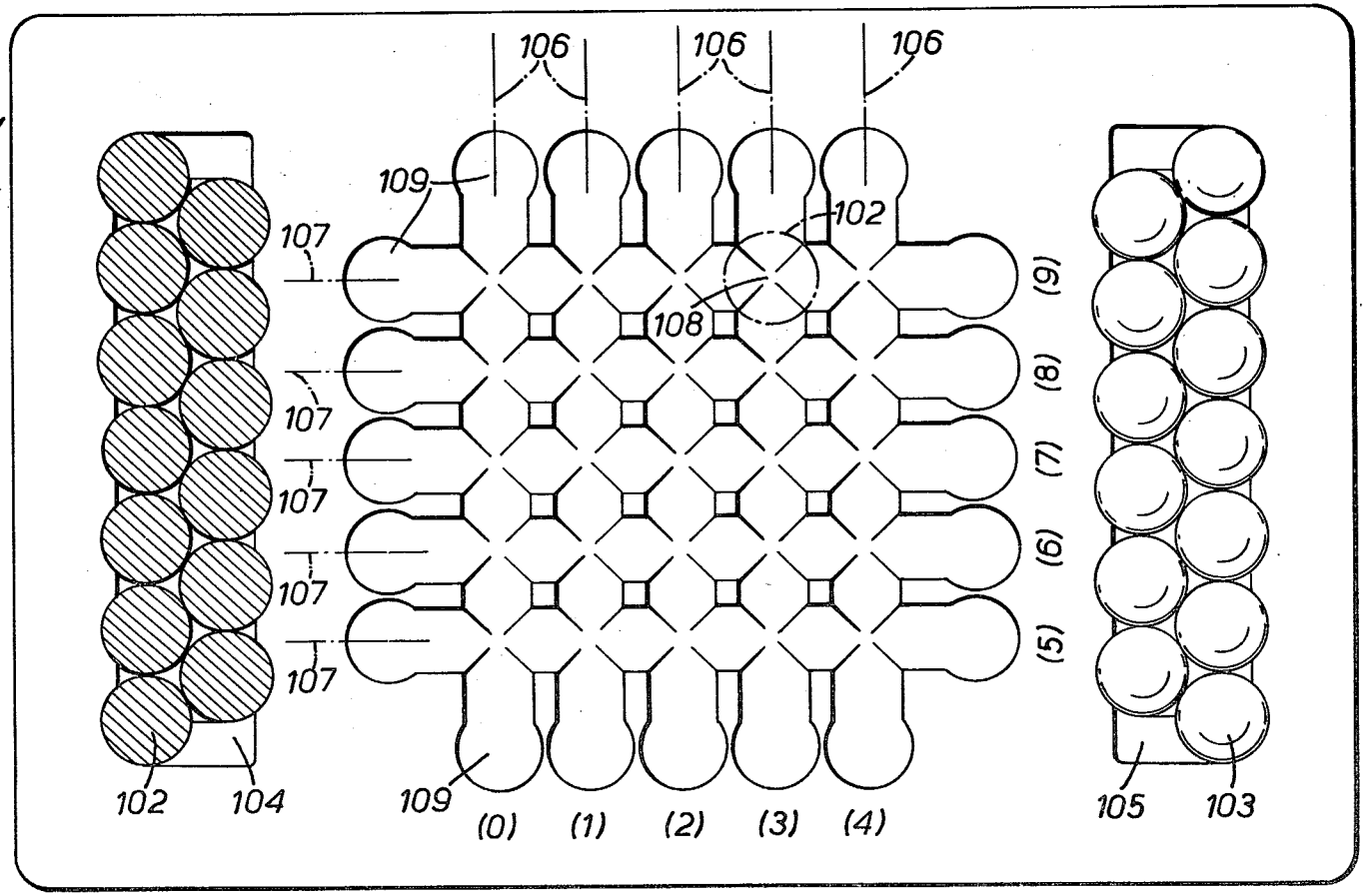
FIG. 1 is a plan view of the playing board and the playing pieces.

Thirteen of the balls are of one colour, for example black, and these are indicated at 102 and the other thirteen balls are of a different colour, for example yellow, and these are indicated at 103. As shown in FIG. 1 the balls are arranged in two storing compartments 104 and 105, the black balls being arranged in the compartment 104, and the yellow balls in the compartment 105.

The playing board is generally cellular in form and consists of two sets of parallel rows, each row being in the form of a channel. The rows of one set indicated by the numeral 106 lies at right-angles to the other set of rows indicated by the numeral 107.

Each of the intersections between the rows in one set and the rows in the other set defines a region 108 for receiving a playing ball; there being twenty five such regions in all. Each region is in the form of a pocket so that it holds a ball in position and places a limited restraint on a ball in that pocket against movement out of that pocket and into an adjacent pocket. The twenty five ball receiving regions form the playing area proper.

The end of each row terminates in a further playing ball receiving region in the form of a further pocket 109 (there being twenty such pockets in all) into which a ball can be placed or displaced when playing the game, as will be described in detail below. The further pockets 109 form a border around the playing area proper and are referred to below as border pockets.

As shown in FIG. 1, two of the rows of border pockets 109 which are adjacent are identified by reference numerals. The border pockets in one row being numbered from 0 to 4 and the border pockets in the other row being numbered from 5 to 9.

The game can be played as a game of patience for one person, or as a competitive game for two persons.

Figure 2:
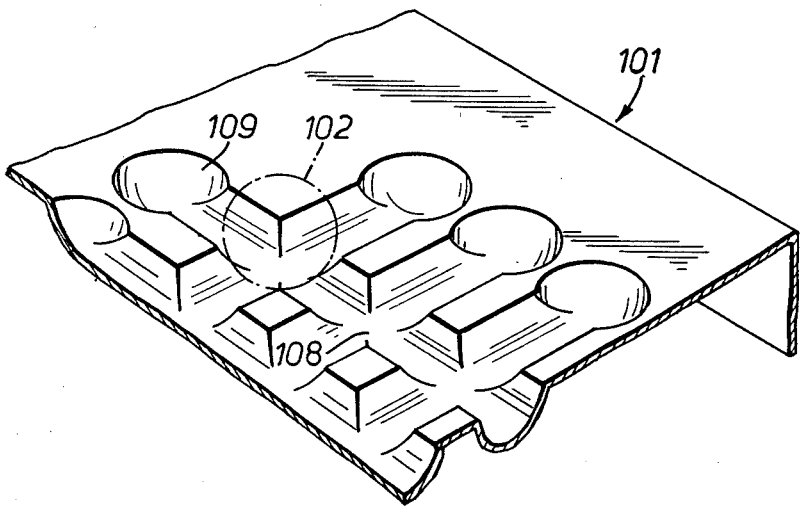
FIG. 2 is a perspective view, partly in section, of part of the playing board.

At the start of the game twenty-five of the balls are arranged in random fashion or in a predetermined pattern on the playing area. That is to say, each playing region or pocket 108 is occupied by a ball; none of the border pockets 109 is occupied. When each of the pockets 108 is occupied (an occupied pocket is shown in phantom lines in FIG. 1 and FIG. 2) the balls are closely adjacent or touching.

The remaining ball is placed in any one of the numbered border pockets 109 and is then pushed against the ball which is at the end of the row to which the border pocket in which the remaining ball has been placed is an extension.

The end ball is pushed in a direction along the axis of that row so that each of the balls in that row except the other end ball—which is moved off the playing area proper and into the border pocket at the other end of that row—is moved into its next adjacent receiving pocket in that row, the said remaining ball taking up the original position of the said end ball. That is to say, one ball is moved into one of the border pockets which are not numbered. The ball which is pushed off the playing area proper and into a border pocket is then picked up and is used for the next push: that is to say the ball which is picked up is placed in one of the numbered border pockets and is used to push the same or a different row.

When the game is a game of patience the balls can be prearranged so that they take up a definite pattern. Thus, for example, the various playing balls can be arranged in any one of the patterns shown in FIGS. 3*a* to 3*p*. The object of the game is then, by a minimum number of pushes, to achieve a different pattern. For example, the playing board can be arranged as shown in FIG. 3*a*. The player then tries with as few pushes as possible to turn that pattern into another pattern, for example that shown in FIG. 3*c*. In this example the transformation from FIG. 3*a* to FIG. 3*c* is solved in the quickest possible way by consecutively placing a ball, and then pushing, in the following number border pockets: 9, 7, 7, 1, 9, 6, 8. The various patterns indicated in FIG. 3*a* to FIG. 3*p* are only given as examples, and many other different patterns could be used.

When the game is used as a competitive game for two players, then the following rules can be used.

The two players draw for who starts. The player starting selects his colour of balls and the other player has the other colour balls. The balls are then arranged on the playing area so that the twenty-five receiving regions or pockets are occupied, and so that the playing ball which is left over is of the colour selected by the person who starts the game.

Preferably, the balls are arranged at the start of the game in a preset pattern, for example as shown in FIG. 3*a*.

By placing the ball which is left over in any one of the border pockets numbered from 0 to 9, the player who starts pushes a given row of balls so that the end ball in that row remote from the border pocket in which the player has placed his ball is pushed off the board and into an unnumbered border pocket. If the ball which is moved into the unnumbered border pocket is of the same colour as the colour selected by the person who is playing, then the same player can perform the next push. If, however, a different colour is pushed into an unnumbered border pocket, then it is the other player's turn to push.

The aim of each player is to achieve in any part of the playing board, a square of three-by-three balls of his colour, for example as indicated in FIGS. 3*q* to 3*t*. As shown in FIGS. 3*q* to 3*t*, black has formed such a square. In the latter mentioned drawings the other balls are all shown as yellow, but of course in practice, either three or four or more of these would be black, and arranged in random fashion on the board.

Figure 3:
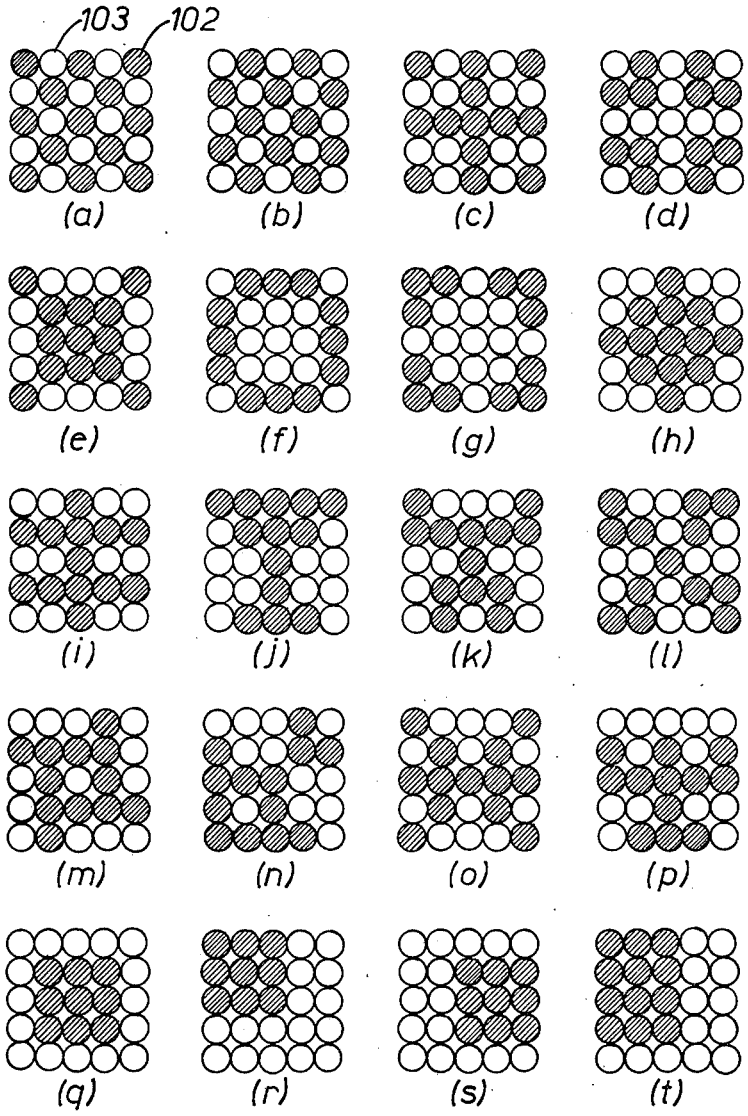
FIGS. 3*a* to 3*t* show various positions of the playing pieces on the playing board.

In the competitive game the rules can be modified so that each player tries to achieve a predetermined pattern, for example as shown in FIG. 3(*c*) or a block of twelve balls (4 by 3) of his colour as shown in FIG. 3(*t*).

Further the rules could include the stipulation that to win the game a player must achieve a block or pattern and that the colour of the last ball to be displaced from the playing area is that player's colour.

The board game as described and illustrated above can be modified in a number of ways. For example, a die or dice could be used to determine the number of consecutive pushes of a player. If a die or dice is used and the ball moved off the playing area by the last push is the same colour as that selected by the player who is pushing, then the rule that that player can have at least one further push can still be used.

The rules of the game can also be modified so that each player can push from any side of the board (which should shorten the game) or from only one side of the board (which should lengthen the game).

It is also possible to modify the game by having playing pieces of more than two colours and allowing three or more players to play.

What I claim is:

1. A game comprising at least two sets of playing pieces, each playing piece being in the form of a ball and having an identifiable characteristic, the playing pieces in each set having the same identifiable characteristic, which characteristic is different from the identifiable characteristic of the pieces in the other set or sets, and a board defining a playing area, the playing area comprising two sets of parallel rows of channels, the rows in one set of rows lying transverse to the rows in the other set of rows, each of the intersections between the rows in one set and the rows in the other set defining a pocket for receiving a playing piece, the total number of playing pieces being at least one more than the number of pockets and the board defining a playing piece receiving region outside the playing area; wherein, in play, every pocket is simultaneously occupied by a playing piece, the playing pieces being visible and lying in substantially the same plane, and the number of pieces in one set of pieces on the playing area is the same as or one more than the number of pieces in the other set or sets of pieces on the playing area, and wherein the playing pieces in a row in which all its pockets are occupied are movable together along the axis of that row by applying a force to one of the two end pieces in that row, using a playing piece which is not in the playing area, so that each of the pieces in that row except the other end piece is moved into its next adjacent pocket in that row, so that the said other end piece is moved off the playing area and into the said receiving region, and so that the playing piece used to apply the force is received in the pocket previously occupied by the same one end piece.

2. A game as claimed in claim 1, in which at least one end of each row is extended beyond the playing area, the extension of each row defining an individual playing piece receiving region, those individual regions being arranged in two further rows, one lying substantially parallel to one of the sets of rows and the other lying parallel to the other set of rows.

3. A game as claimed in claim 2, in which each of the individual receiving regions which is in the further row lying parallel to one of the sets of rows and each of the individual receiving regions which is in the row lying parallel to the other set of rows has an identifiable characteristic.

4. A game as claimed in claim 3, in which the identifiable characteristic is a number or a letter.

5. A game as claimed in claim 1, in which each end of each row is extended beyond the playing area, each extension of each row defining an individual playing piece receiving region, those individual regions being arranged in four further rows, one of the sets of rows lying between the substantially parallel to two further rows, and the other set of rows lying between and substantially parallel to the other two further rows.

6. A game as claimed in claim 5, in which each of the individual receiving regions which is in a further row lying parallel to one of the sets of rows and each of the individual receiving regions which is in a row lying parallel to the other set of rows has an identifiable characteristic.

7. A game as claimed in claim 6, in which the identifiable characteristic is a number or a letter.

8. A game as claimed in claim 1, in which the spacing between adjacent rows in one set is the same and equal to the spacing between adjacent rows in the other set.

9. A game as claimed in claim 1, in which the two sets of rows lie at right-angles to each other.

10. A game as claimed in claim 1, in which the playing area is square in shape.

11. A game as claimed in claim 1, in which the identifiable characteristic of each playing piece is the colour of the playing piece.

12. A game as claimed in claim 1, in which there are only two sets of playing pieces.

* * * * *